US007129807B2

(12) United States Patent
Rossmanith et al.

(10) Patent No.: US 7,129,807 B2
(45) Date of Patent: Oct. 31, 2006

(54) UNDULATOR AND METHOD OF OPERATION THEREOF

(75) Inventors: Robert Rossmanith, Walzbachtal (DE); Uwe Schindler, Bremen (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 11/363,427

(22) Filed: Feb. 27, 2006

(65) Prior Publication Data

US 2006/0158288 A1 Jul. 20, 2006

Related U.S. Application Data

(63) Continuation-in-part of application No. PCT/EP2004/013466, filed on Nov. 27, 2004.

(30) Foreign Application Priority Data

Dec. 12, 2003 (DE) ..... 103 58 225

(51) Int. Cl.
*H01F 6/00* (2006.01)

(52) U.S. Cl. ..... 335/216; 315/5.35; 315/501; 315/503; 372/2; 372/37

(58) Field of Classification Search ..... 315/5.34–5.35, 315/501, 503, 507; 372/2, 37, 73; 335/216, 335/299

See application file for complete search history.

(56) References Cited

FOREIGN PATENT DOCUMENTS

JP 63226899 A * 9/1988
JP 02 306599 12/1990
JP 10 302999 11/1998

OTHER PUBLICATIONS

H.O. Moser, et al. "Magnetic Field of Superconductive In-vacuo Undulators in Comparison with Permanent Magnet Undulators", Nuclear Instruments & Methods in Physics Research, Section A, Elvesier Netherlands. vol. 490, No. 1-2, 2002.

S. Sasaki, "Design for a Superconducting Planar Helical Undulator", Workshop on Superconducting Undulators & Wigglers, pp. 1-11.

H. Kitamura, "Production of Circularly Polarized Synchrotron Radiation", Synchrontron Radiation News, Reading, GB, vol. 5, No. 1, 1992.

* cited by examiner

*Primary Examiner*—Ramon M. Barrera
(74) *Attorney, Agent, or Firm*—Klaus J. Bach

(57) ABSTRACT

In an undulator for the generation of synchrotron radiation from a particle beam introduced into the undulator, two partial undulators are provided each comprising a conductor of superconductive material which, when a current is conducted therethrough, generates an undulator field that extends perpendicularly to the current flow, and the superconductive conductors are arranged in the individual partial undulators such that the undulator fields generated are not parallel, whereby, by controlling the energization of the two partial undulators, the polarization direction of the synchrotron radiation can be adjusted without mechanical movements.

6 Claims, 2 Drawing Sheets

UNDULATOR AND METHOD OF OPERATION THEREOF

This is a Continuation-in-Part Application of PCT/EP2004/013466 filed Nov. 27, 2004 and claiming priority of German Application 103 58 225.8 filed Dec. 12, 2003.

BACKGROUND OF THE INVENTION

The invention relates to undulators which serve as a source of electromagnetic radiation called below also light, which is generated from a particle stream (for example of electrons) passing through the undulator and to a method of operating such an undulator. Undulators are used particularly for the generation of x-rays in synchrotron radiation sources.

World with numerous attempts have been made to construct undulators from permanent magnets in such a way that the polarization direction of the light emitted by the undulators can be changed by mechanical movements. An overview of the techniques can be found in H. Onuki and P. Elleaume, Undulators, Wigglers, and their Applications, chapter 6, Polarizing undulators and wigglers, Tayler and Francis, 2003. According to the state of the art described therein two ways are known by which the polarization direction can be changed:

by mechanical displacement of the permanent magnets or, by division of the undulator and manipulation of the beam between the undulator parts.

The first solution requires expensive mechanical structures to permit movement of the magnets under the high forces effective on the magnets. The electron synchrotron BESSY in Berlin for example uses permanent magnet undulators with mechanically variable polarization structures. A variant of this equipment is disclosed in JP 103 03 999 A. The second solution has only limited applicability for normal operation, that is, it can be used only in connection with low radiation energies and is therefore without importance in practice.

Immediately after the disclosure of the superconductive planar undulators in R. Rossmanith and H. O. Moser, Study of a Superconductive in-vacuo Undulator for Storage Rings with an Electrical Tunability between K=0 and K=2, Proc. European Accelerator Conference, 2000, Vienna, there were speculations whether it would not be possible to wind superconductive undulators with helical polarization. The first technical comment was provided by R. P. Walker, who was at that time director of Elettra, Triest, New concept for a Planar Superconducting Helical Undulator, 18$^{th}$ Oct. 2000. A further conceptual sketch for a helical undulator was provided by R. Pitthahn and J. Sheppard, SLAC, Use of a Microundulator to Study Positron Production, 5$^{th}$ Feb. 2002.

A further summary is found in a presentation of Shigemi Sasaki, Argonne, Design for a superconducting planar helical undulator, ESRF, June 2003, wherein the author approves the idea to extend the concept of the superconductive planar undulators to helical undulators but states that it is not clear how one could change the polarization direction.

Based on this prior art and knowledge, it is the object of the present invention to provide an undulator and a method for the operation of an undulator which does not have the disadvantages and limitations mentioned above. Particularly a superconductive undulator is to be provided which permits a change and adjustment of the polarization direction of the synchrotron radiation without mechanical movement. The arrangement is to permit for example a switch-over of the polarization direction of the synchrotron radiation from linear to circular or to change the helicity direction, the helicity defining the direction of rotation of the electric field.

SUMMARY OF THE INVENTION

In an undulator for the generation of synchrotron radiation from a particle beam introduced into the undulator, two partial undulators are provided each comprising a conductor of superconductive material which, when a current is conducted therethrough, generates an undulator field that extends perpendicularly to the current flow, and the superconductive conductors are arranged in the individual partial undulators such that the undulator fields generated are not parallel, whereby, by controlling the energization of the two partial undulators, the polarization direction of the synchrotron radiation can be adjusted without mechanical movements.

With the concept according to the present invention, the polarization direction of the emitted synchrotron radiation is controlled in that the conductor arrangement of a superconductive undulator is so formed that the polarization direction can be adjusted or changed by changing the current direction in the superconductive conductor arrangement without mechanical movements. With these provisions, the polarizations direction of the radiation emitted can be switched in particular from linear to cyclic or, respectively, the helicity can be changed.

An embodiment of the invention will be described below on the basis of the accompanying drawings.

DESCRIPTION OF THE OPERATING PRINCIPLE AND AN UNDULATOR ACCORDING TO THE INVENTION

The principal features of an undulator according to the invention will be explained on the basis of FIG. 1. The operation of an undulator with variable polarization direction in accordance with the invention is based on an arrangement of two different conductors (coils) of superconductive material which can be independently energized.

An undulator according to the invention consequently comprises two superconductive partial undulators, that is:

a) a first partial undulator including a superconductive high-capacity coil or conductor through which the current $I_1$ flow and which with regard to its distance from the electron beam E is designated the inner undulator, and b) a second partial undulator including a superconductive high capacity conductor through which the current $I_2$ flows and which is disposed at a greater distance from the electron beam E than the second partial undulator and, therefore, is designated the outer undulator. The two currents $I_1$ and $I_2$ are independently adjustable.

Figure 1:
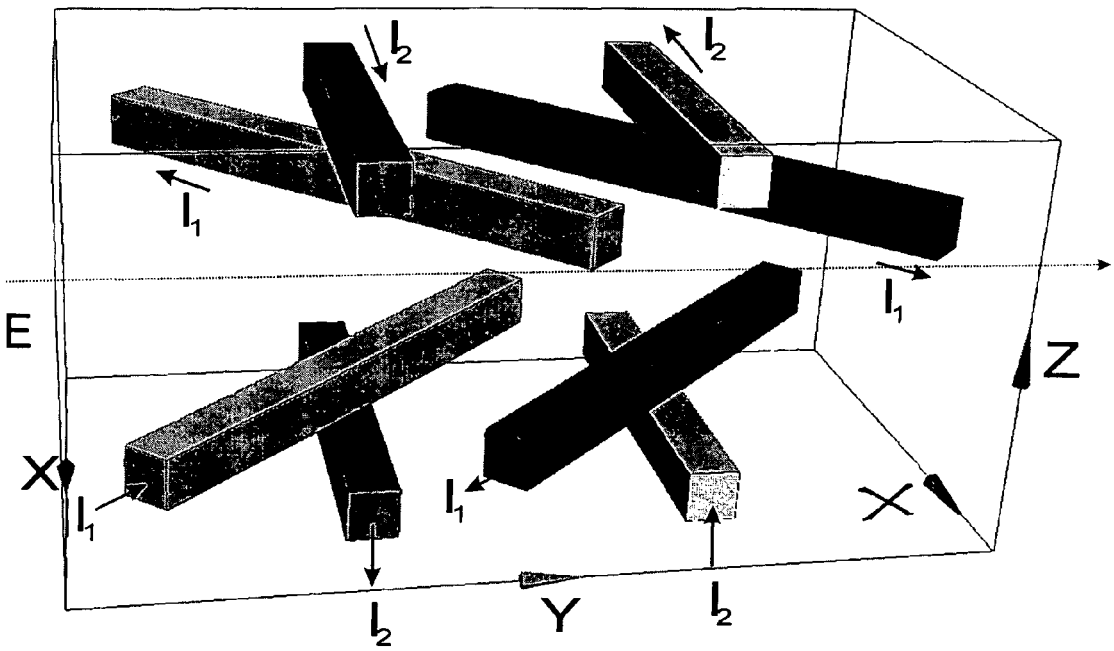
FIG. 1 shows the principle on which an undulator according to the invention is based.

As apparent from FIG. 1, the second partial undulator includes a conductor arrangement oriented essentially in the x-direction and, consequently, generates—in accordance with the state of the art—an undulator field which is oriented essentially in the z-direction. A particle beam (electron beam) which would pass through this undulator in the y-direction would generate linearly polarized light.

The conductor arrangement of the first partial undulator is such that its conductors extends at an angle of 15° to 75°, preferably 30° to 60° and especially at about 30°, about 45° or about 60° with respect to the conductors of the second partial undulator, which extend in the x-direction, as well as to the direction of the electron beam, which extends in the y-direction. This means that the conductors of the first partial undulator assume a certain angle relative to the x-z plane defined by the second partial undulator and the undulator field. As a result, in the first partial undulator, an undulator field is generated which—like in the second partial undulator—has a component in the z-direction and, furthermore, a component in the x-direction which is different from zero. As a result of this conductor arrangement according to the invention, the radiation generated therewith is circularly polarized and has a certain helicity.

A superconductive undulator according to the invention is operated as follows: First, a first current of the value $I_i$ is switched on which flows through the superconductor of the first (inner) partial undulator whereby circularly polarized light of a certain direction is generated. Generally, however, this direction does not correspond to the desired helicity for the circular radiation. In order to adjust this direction so as to achieve coincidence, a second current with a value $I_2$ is switched on to flow through the second (outer) partial undulator, wherein the value $I_2$ is so selected that the undulator field in z-direction is partially compensated for such that the desired helicity of the circular radiation is obtained.

If the values $I_1$ and $I_2$ of the two currents are so selected that the z-components of the two partial undulators compensate each other, an undulator field in x-direction only is generated. When the value $T_1$ is further increased, a radiation with opposite helicity is emitted from the undulator.

As a result, with the present invention, the helicity of the emitted synchrotron radiation can be adjusted to any desired value without the need for mechanical movements of any parts. In this way, therefore light with both directions of rotation, elliptically polarized light and linearly polarized light, can be generated and this can be achieved while, at the same time, the arrangement of an undulator with variable polarization is substantially simplified.

Referring to a particular embodiment set up at the Forschungszentrum Karlsruhe, the WERA beam line of the synchrotron radiation source ANKA includes an undulator with the following dimensions:

| | |
|---|---|
| Gap, that is free opening for the introduction of the electron beam | 17 mm |
| Angle of the helical coil | 45° |
| Period | 50 mm |
| Number of Periods | 40 |
| Overall length | 2 m |

Figures 2A, 2B:
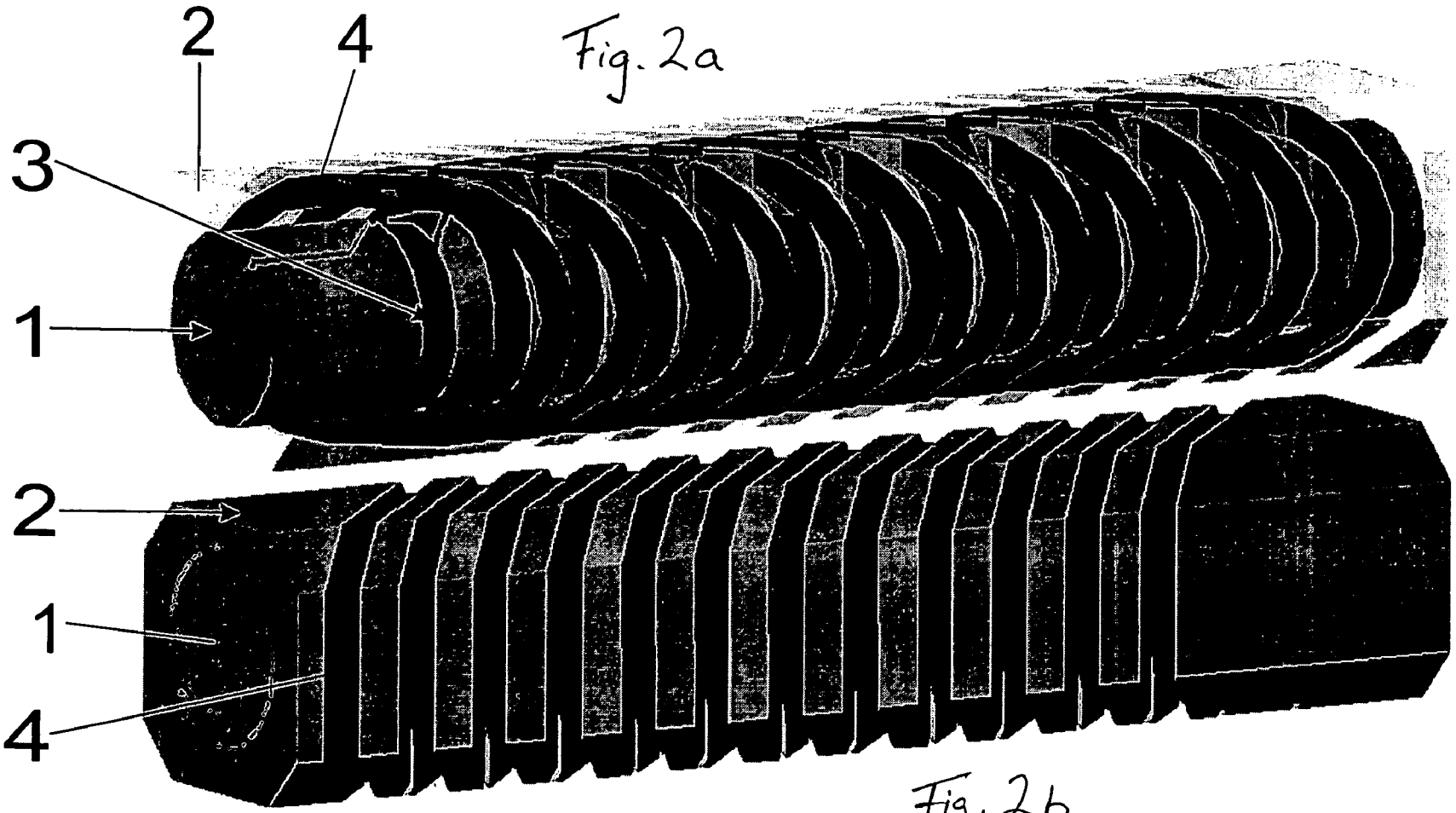
FIG. 2 is a cross-sectional view of an undulator according to the invention.

FIGS. 2*a* and 2*b* are cross-sectional views of two sections of this undulator, wherein in each case twelve of the forty periods are depicted. The undulator consists of the two partial undulators 3 and 4 which will be designated below a planar undulator 3, which generates an undulator field in z-direction and, respectively, a helical undulator 4, which generates an undulator field which has components in z-direction and also in the x-direction. The helical undulator 4 is disposed at an angle of 45° with respect to the planar undulator 3.

The undulators each consists of an iron body 1 surrounded by magnetically inactive material 2 in which the superconductive coils of the planar partial undulator 3 are contained and, respectively, in which the superconductive coils of the helical partial undulator 4 are disposed.

Upon operation of the helical and the planar partial undulators according to the invention, the following undulator fields are obtained: In this connection $B_2$ and $B_x$ indicate the undulator field magnitude in the z and, respectively, x direction. The period length is 50 mm.

| Arrangement | Helically one direction | Helically other direction | Planar vertically | Planar horizontally |
|---|---|---|---|---|
| Current flow Helical part | 350 A | 350 A | 0 A | 350 A |
| Current flow planar part | −145 A | −980 A | −250 A | −400 A |
| Phase between $B_2$ and $B_x$ | $90^0$ | −88.56 | — | — |
| $B_{z\ max}$/Tesla | 0.285467 | 0.283389 | 0.284269 | — |
| $B_{x\ max}$/Tesla | 0.283069 | 0.283069 | — | 0.283069 |

What is claimed is:

1. An undulator for generating synchrotron radiation from a particle beam directed into the undulator, said undulator comprising at least two partial undulators, each partial undulator including a conductor of a super conductive material, which, upon energization by a current, generates an undulator field which is oriented normal to the direction of the current flow through the conductor, said conductor of superconductive material being disposed in the individual partial undulators such that the undulator fields generated by the individual partial undulators are not parallel to each other and means for controlling the magnitude of the currents flowing through the conductors of superconductor material of the individual undulators independently of one another such that the undulator field resulting from a superimposition of the undulator fields generated by the partial undulators determines the polarization direction of the synchrotron radiation.

2. An undulator according to claim 1, wherein a first partial undulator is so arranged that it has a first undulator field, which extends essentially normal to the direction of the particle beam, and a second partial undulator is so arranged that it has a second undulator field, which has a component different from zero in the direction of the first undulator field and in that direction which extends essentially normal to the direction of the first undulator field and essentially normal to the direction of the particle beam.

3. An undulator according to claim 1, wherein the first and second partial undulators are arranged at an angle with respect to each other in the range between 15° and 75°.

4. An undulator according to claim 3, wherein the angle at which the partial undulators are arranged relative to each other is between 30° and 60°.

5. A method of operating an undulator for generating synchrotron radiation from a particle beam introduced into the undulator, comprising the steps of: applying to a first arrangement of a conductor of superconductive material of a first partial undulator a first current, whereby a first undulator field is generated, which extends perpendicularly to the direction of the first current, applying to a second arrangement of a conductor of superconductive material of a second partial undulator a second current, whereby a second undulator field is generated which extends perpendicularly to the direction of the second current but not parallel to the first undulator field, wherein the magnitudes of the first and the second current are so selected that the resulting undulator field, which is established by the superimposition of the first and the second undulator fields, determines the polarization direction of the synchrotron radiation.

6. A method, of operating an undulator according to claim 5, wherein the magnitudes of the currents through the conductors of superconductive material of the two partial undulators is so selected that the components of the two undulator fields compensate each other in the direction of the undulator field, whereby a composite undulator field is generated which extends normal to the direction of the first undulator field and to the direction of the particle beam.

* * * * *